United States Patent [19]

Saitoh et al.

[11] Patent Number: 5,066,055

[45] Date of Patent: Nov. 19, 1991

[54] LOCKING DEVICE FOR HOOD

[75] Inventors: Takeshi Saitoh; Nozomu Kohno, both of Kariya, Japan

[73] Assignee: Kabushiki Kaisha Toyoda Jidoshokki Seisakusho, Kariya, Japan

[21] Appl. No.: 609,424

[22] Filed: Nov. 5, 1990

[30] Foreign Application Priority Data

Nov. 13, 1989 [JP] Japan ..... 1-294463

[51] Int. Cl.[5] ..... E05C 3/04

[52] U.S. Cl. ..... 292/228; 292/DIG. 14; 292/337; 292/DIG. 31

[58] Field of Search ..... 292/DIG. 31, DIG. 43, 292/DIG. 14, 121, 128, 219, 228, 336.3, 337; 180/69 R; 296/35 A, 76

[56] References Cited

U.S. PATENT DOCUMENTS

| | | | |
|---|---|---|---|
| 2,031,302 | 2/1936 | Clark | 292/128 X |
| 2,197,195 | 4/1940 | Schemers | 292/DIG. 31 X |
| 2,634,997 | 4/1953 | Gallowitz | 292/128 |
| 3,976,157 | 8/1976 | Wahnemuehl | 292/228 X |
| 4,893,850 | 1/1990 | Mizusawa | 292/128 |

*Primary Examiner*—Richard E. Moore

*Attorney, Agent, or Firm*—Brooks Haidt Haffner & Delahunty

[57] ABSTRACT

A locking device for a closable box-shaped hood provided in an industrial vehicle. The hood has a recess on its lateral surface, a rotatable locking unit having a lever is provided in the recess, and a hood catch for engaging with a key-shaped section of the locking unit is provided on the vehicle.

4 Claims, 6 Drawing Sheets

LOCKING DEVICE FOR HOOD

BACKGROUND OF THE INVENTION

1. Field of the Invention

This invention relates to a locking device for a hood adapted for covering an engine, a battery or the like of an industrial vehicle.

2. Related Art

Referring to FIG. 1 to 3, a conventional locking device 9 for a hood 3 is provided on a front surface 32 of the hood 3 of an industrial vehicle, such as a fork lift truck.

The locking device 91 as disclosed in Japanese Utility Model Kokai Publication No. 59-56 (1984), is comprised of a holder 90, a handle 91 and a catch lever 92.

Referring to FIG. 2, the handle 91 is rotatably mounted on a pivot shaft 93 of the holder 90. The catch lever 92 has its one end rotatably mounted on the handle 91, while having its other end engageable with a hood catch 8.

The hood catch 8 is secured by a bolt 81 to a frame 4 of a vehicle chassis.

Further, a handle 7 for opening or closing the hood 3 is provided on a lateral surface 37 of the hood 3, as shown in FIG. 1 and 3, while a hinge 30 is provided at the rear end of the hood 3.

For opening the hood 3, the handle 91 is pulled in the direction C as shown in FIG. 2. This lowers the catch lever 92 as shown by an arrow G. The catch lever 92 is then pulled as shown by an arrow D, the catch lever 92 being thus released from the hood catch 8. The handle 7 is then raised manually to open the hood 3. When closing the hood 3, the reverse of the above described operation is performed to close and lock the hood 3.

The above described prior-art technology has, however, the following disadvantages.

That is, the locking device 9 is mounted near the driver's foot, as shown in FIG. 8, such that the driver may have his or her foot caught by the locking device 9 when getting on or alighting from the vehicle. The locking device 9 mounted in a protruding manner on the front side 32 of the hood 3 is awkward in appearance.

The handle 7 is provided with a substantially U-shaped recess 71 above the frame 4, as shown in FIG. 3. An elastic seal 73 and an abutment seal 72 having a notch 720 are provided at the recess 71, resulting in a complex seal mounting structure and awkward appearance.

OBJECT AND SUMMARY OF THE INVENTION

It is therefore an object of the present invention to provide a locking device for a hood which is simple in construction and operation and has an excellent appearance.

The present invention provides a locking device for a closable box-shaped hood provided in an industrial vehicle, wherein said hood has a recess on its lateral side, a rotatable locking unit having a lever is provided in said recess, and a hood catch for engaging with a key-shaped section of said locking unit is provided on the vehicle.

It is an important feature of the present invention that the locking unit having the lever is provided in the recess on the lateral side of the hood and the hood catch engaged by the key-shaped section of the locking unit is provided on the vehicle.

The lateral side of the hood means the front side, a left-hand lateral side or a right-hand lateral side.

As the locking unit, a device having a lever and adapted for rotationally biasing the key-shaped section by a spring, is used. (FIGS. 6 and 7).

As the hood catch, a substantially U-shaped retention member mounted on the vehicle and engaging with a key-shaped section of the locking unit is used (see FIG. 5).

The locking unit and the hood catch are arranged so as to be engaged on closure of the hood with each other and accommodated in a recess defined in the hood. The locking device for the hood according to the present invention is opened and closed by the following sequence.

The user's hand is inserted into the recess from below the lever to grip the lever.

The lever is pulled towards the user. This disengages the key-shaped section of the locking unit from the hood catch.

The key-shaped section is turned upwards under the biasing force of the elastic member. After the key-shaped section is halted in an upper position, the hood is lifted, while the lever is held manually, for opening the hood.

When closing the hood, the lever is grasped and the hood is lowered. In this manner, the key-shaped section of the locking unit is engaged with the hood catch. Thus the locking unit is brought to the locked state to close the hood.

BRIEF DESCRIPTION OF THE DRAWINGS

FIGS. 1 to 3 illustrate a locking unit of the conventional hood, wherein FIG. 1 is a perspective view there of.

FIG. 2 is a cross-sectional view taken along line A—A of FIG. 1.

FIG. 3 is a cross-sectional view taken along line B—B of FIG. 3.

FIGS. 4 to 8 illustrate a locking device for a hood according to an embodiment of the present invention, wherein FIG. 4 is a cross-sectional view thereof.

FIG. 5 is a perspective view showing the opening state thereof.

FIG. 6 is a partial perspective view of the locking unit.

FIG. 7 is a side elevational view of the locking unit.

FIG. 8 is a side elevational view of a fork lift truck.

DESCRIPTION OF PREFERRED EMBODIMENT

A locking device for a hood according to an embodiment of the present invention will be explained by referring to FIGS. 4 to 8.

Figure 8:
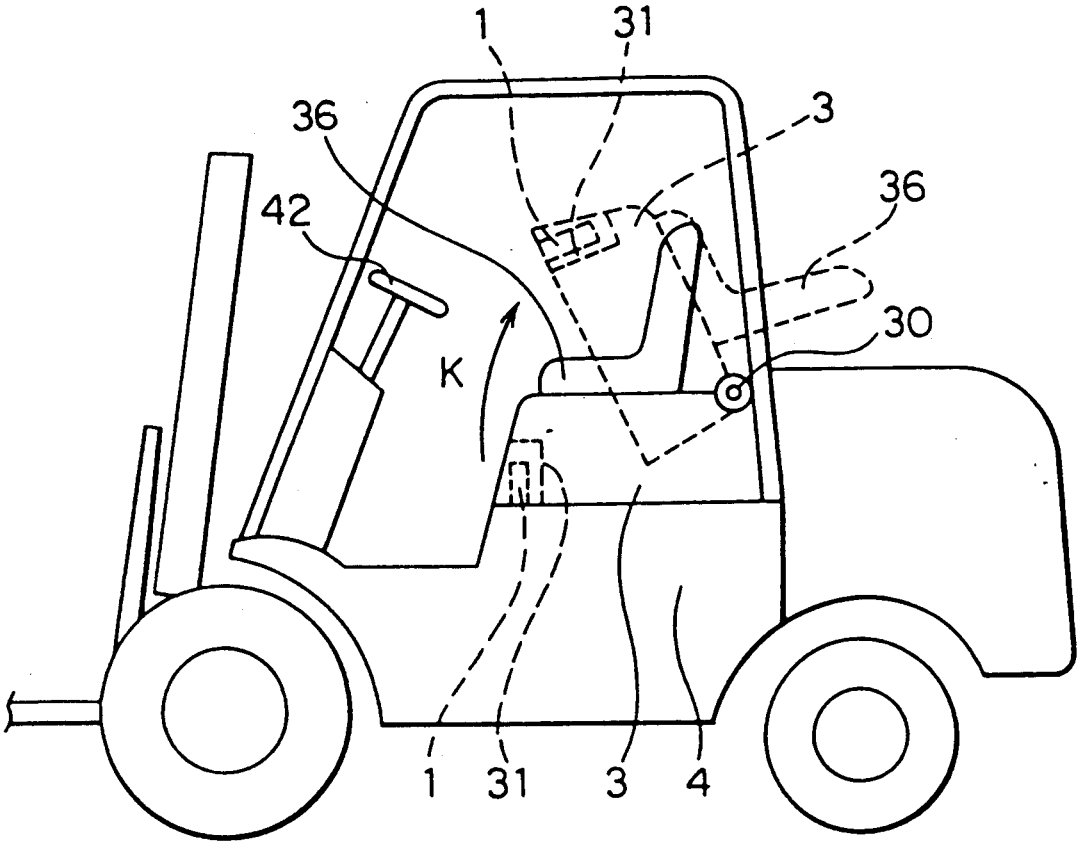

As shown in FIG. 8, the locking device of the present embodiment is a locking device for a closable box-shaped hood 3 provided in the fork lift truck.

The hood 3 has a recess 39 formed by a concave plate 31 on its front lateral surface 32.

As shown in FIGS. 4 to 7, a rotatable locking unit 1 having a lever 10 is provided within the recess 39, while a hood catch 2 for engaging with a key-shaped section 12 of the locking unit 1 is provided on a frame 4 of the vehicle body.

Said recess 39 is formed by a substantially U-shaped concave plate 31 provided at the center of the front lateral surface 32 of the hood 3. An elastic sealing member 33 is provided at the lower end of the concave plate 31.

Figure 1:
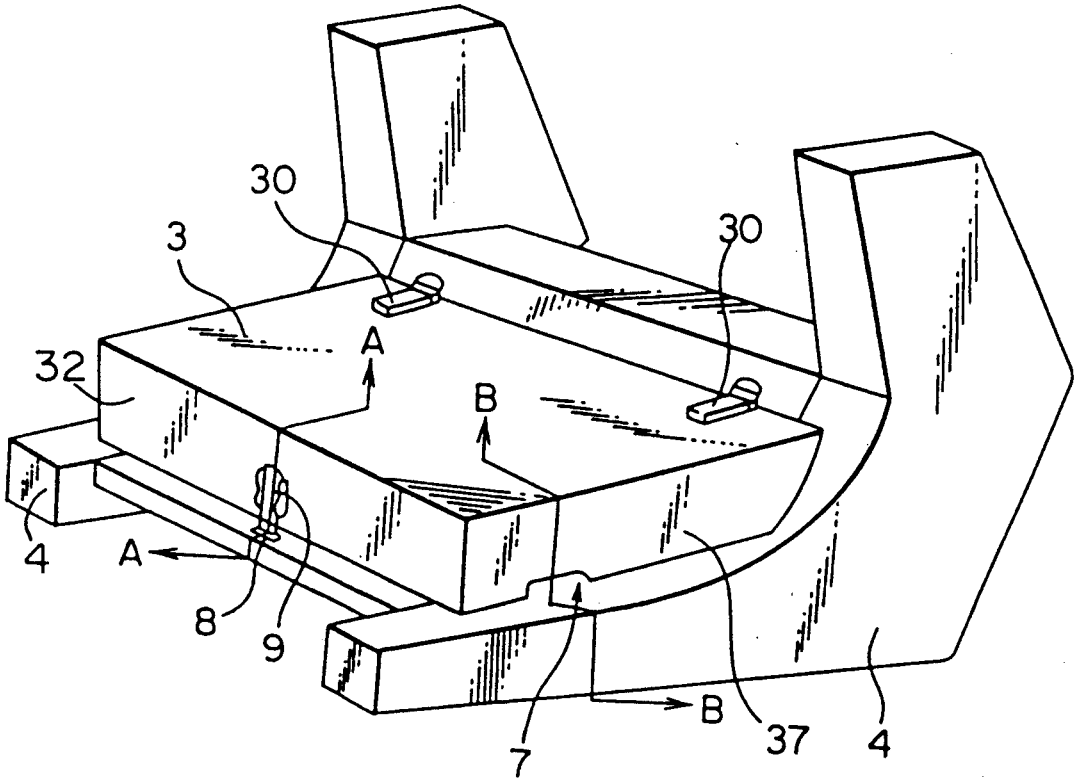
FIG. 1 (PRIOR ART)
Figure 2:
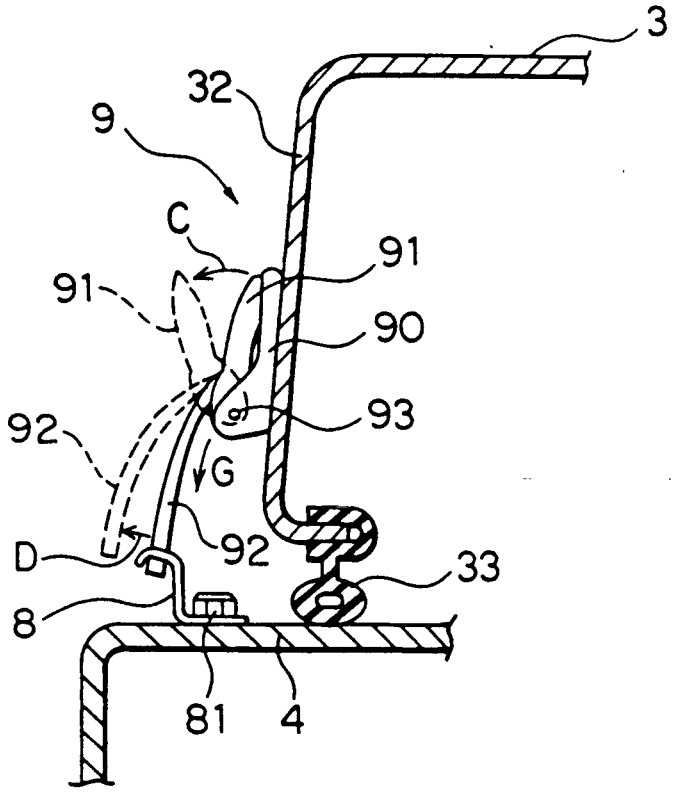
FIG. 2 (PRIOR ART)
Figure 3:
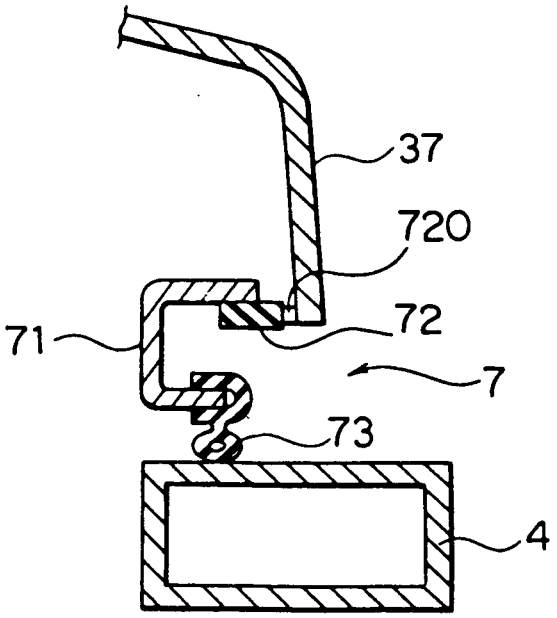
FIG. 3 (PRIOR ART)
Figure 4:
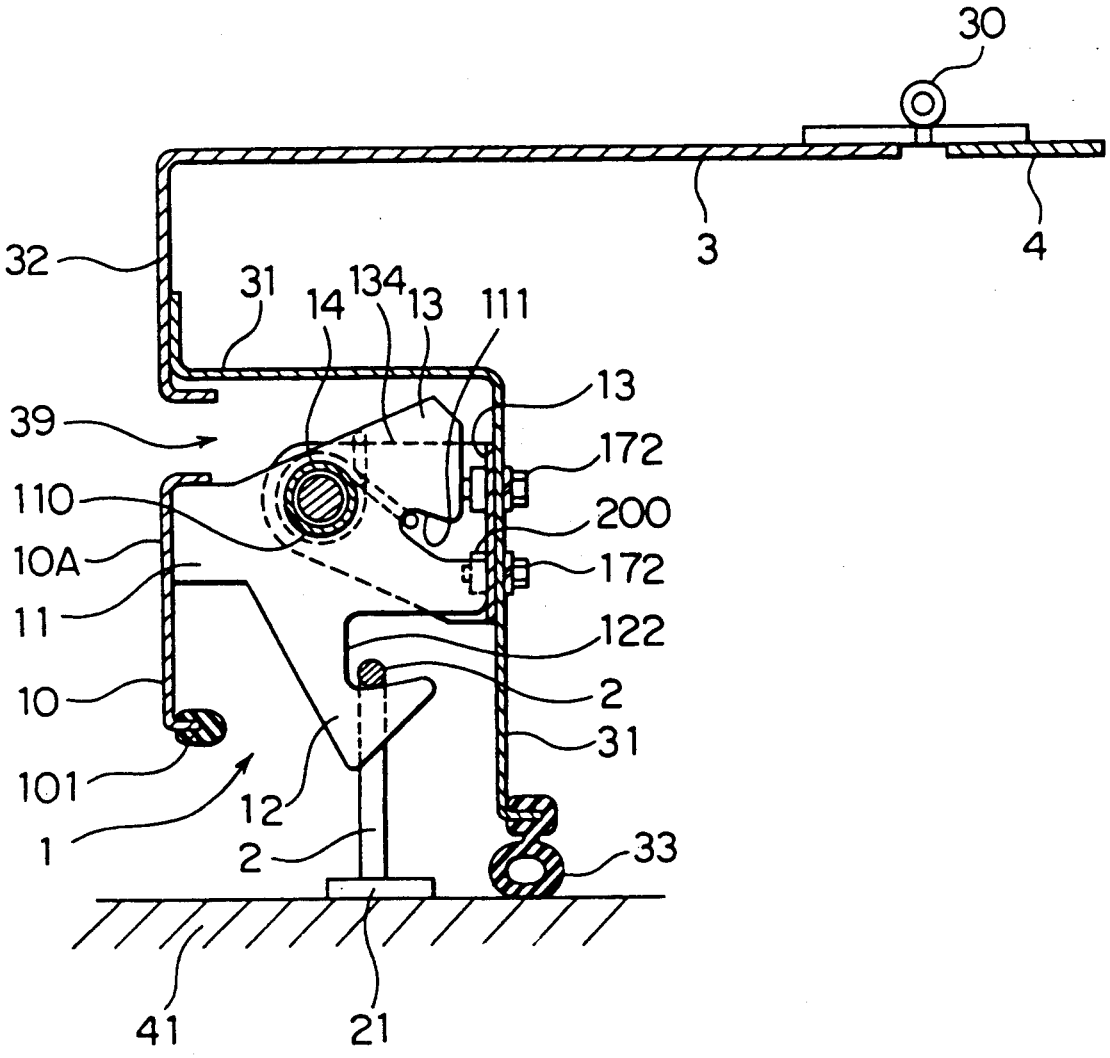

An outer surface 10A is aligned at the same surface position as said front lateral surface 32 from stand point of a flat view as shown in FIG. 4.

Figure 6:
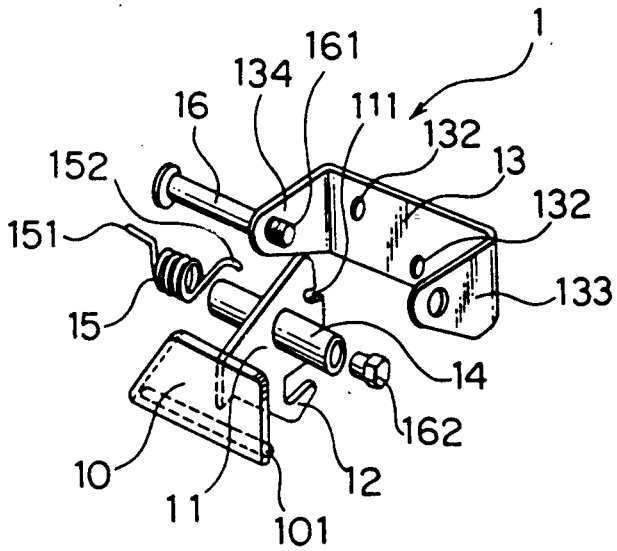

Referring to FIG. 6, the locking device 1 is constituted by a lever 10, a main retention plate member 11 connected to the rear of the lever 10, a key-shaped section 12 at the foremost part of the main retention plate member 11, a tubular pivot shaft 14 for rotatably mounting the main retention plate member 11 and a bearing plate 13 for supporting the pivot shaft 14 by a pin 16. The bearing plate 13 is secured in position by a nut 172 applied to a bolt 200 which is passed through an opening 132 and through a concave plate 31.

Figure 7:
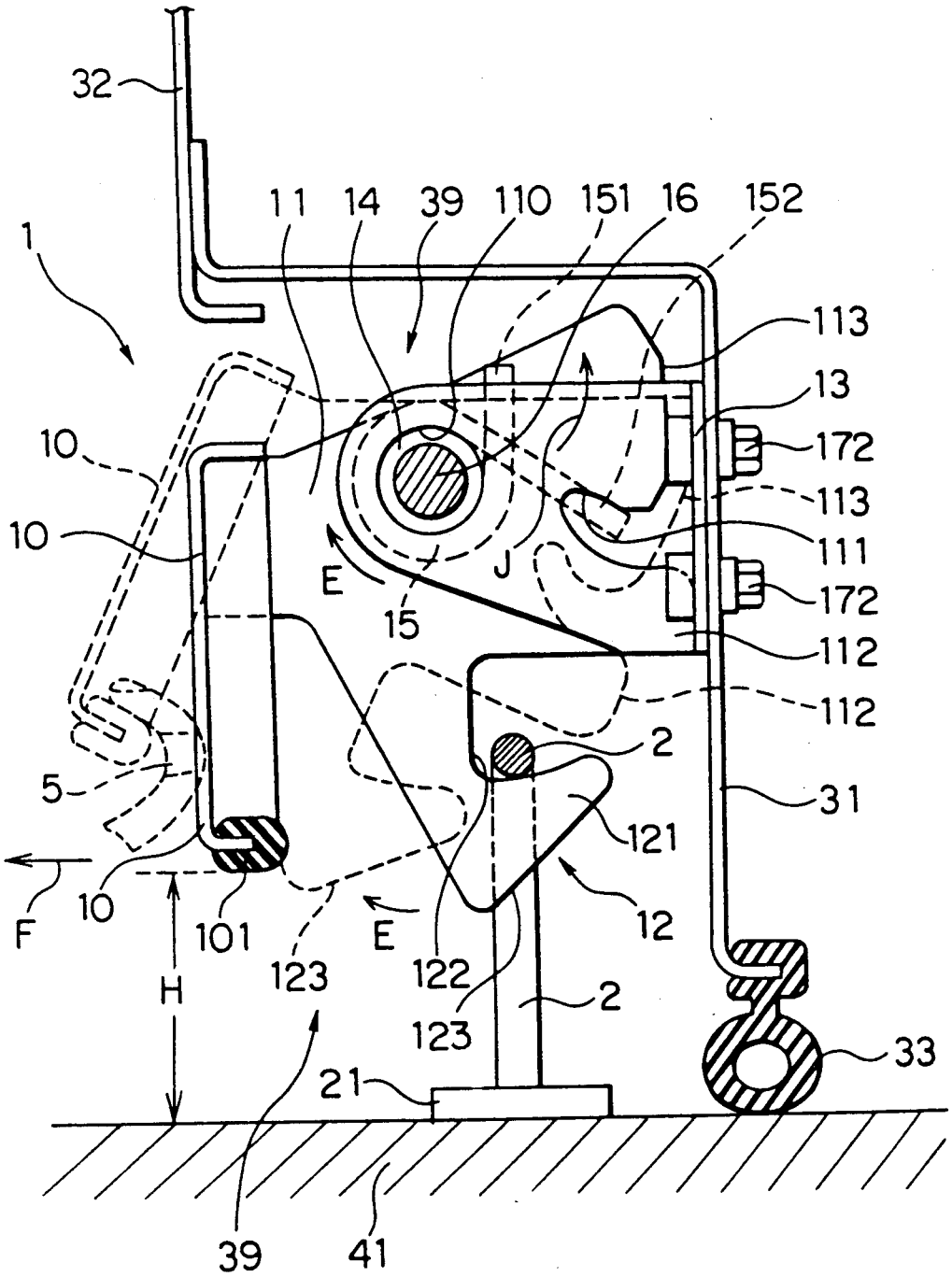

Referring to FIG. 6 and 7, the lever 10 is in the form of a trapezoid and has an elastic lower handle 101. As shown in FIG. 7, the lever 10 has a space H between the elastic handle 101 and a frame bridging plate 41.

The main retention plate member 11 is sector-shaped and has an upper central core opening 110 into which the pivot shaft 14 is inserted. A coil spring 15 is inserted about the outer periphery of the pivot shaft 14.

For mounting, the pivot shaft 14 inserted into the main retention plate member 11 and is placed between both sides 133, 134 of the bearing plate 13. The pin 16 is inserted into the pivot shaft 14 and the nut 162 is threadedly secured to a threaded portion 161 thereof. A coil spring 15 is fitted about the pivot shaft 14. The one end 152 of the coil spring 15 is retained by a spring retainer 111 of the key-shaped section 12, while the other end 151 thereof is retained by a side 134 of the bearing plate 13. Thus the coil spring 15 biases the key-shaped section 12 in a closing direction shown by an arrow J. The section 12 is substantially L-shaped and has an end hook 121. The section 12 has a retainer 122 between it and the main retention plate member 11. The main retention plate member 11 has a substantially U-shaped spring retainer 111, a first abutment 112 and a second abutment 113.

Figure 5:
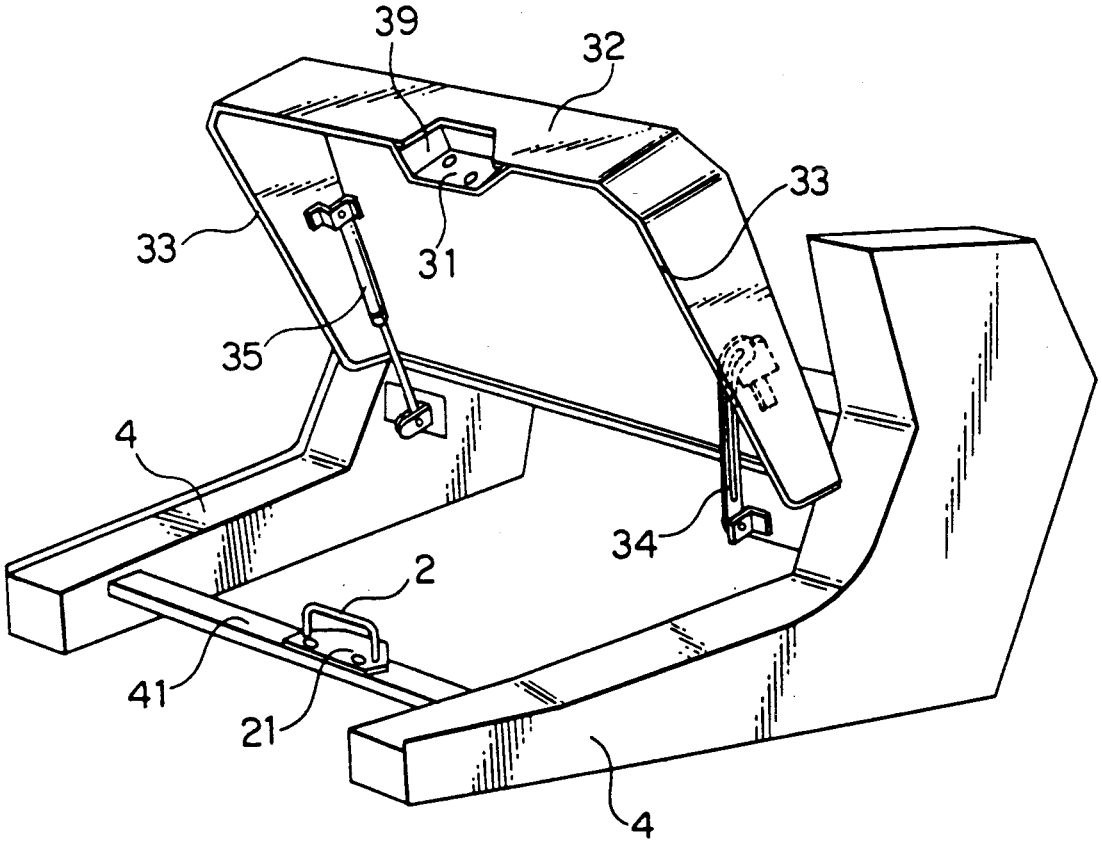

Further, the frame 4 is provided with a hood catch 2 for engaging with the section 12 of the locking unit 1, as shown in FIG. 5. The hood catch 2 is substantially U-shaped and is mounted on the frame bridging plate 41 by means of a mounting plate 21.

The closable box shaped hood 3 has an upper rear hinge 30, as shown in FIG. 4. Said hinge 30 is mounted on the hood 3 and the frame 4. An elastic sealing member 33 is mounted on the lower rim of the hood 3, as shown in FIG. 5. Said hood 3 is provided with guide member 34 and damper 35 interlocked with the opening movement of the hood 3 for supporting the hood during the opening thereof.

A seat 36 is provided as conventionally above hood 3, as shown in FIG. 8.

The operation of the locking device for hood 3 is hereinafter explained.

The locking device for the hood 3 of the present embodiment is opened or closed by the following procedure.

That, as shown in FIG. 7, a hand 5 is inserted into the recess 39 via the space H below the lever 10. The lever 10 is held manually.

The lever 10 is then pulled in a direction shown by an arrow F against the bias of the coil spring 15. This causes the section 12 of the locking unit 1 to be rotated about pin 16 so as to be disengaged from hood catch 2. By such rotation, the upper abutment 113 of the main retention plate member 11 abuts on the bearing plate 13, as shown by a broken line FIG. 7. Thus the main retention plate member 11 is unable to be rotated further.

Then, with the lever 10 gripped by the hand 5, the hood 3 is lifted, so that the hood 3 is in the open state, as shown in FIG. 5 and 8. The hood 3 does not conflict with the handle 42 since the locking device is not mounted on the front side as in the conventional device.

When closing the hood 3, the front side of the hood 3 is pulled downwards. At this time the section 12 of the main retention plate member 11 is above the hood catch 2. Hence, when the hood 3 is being closed, the lower inclined portion 123 of the hook 121 of the key-shaped section abuts on the hood catch 2. With continued descent of the hood 3, the inclined portion 123 is lowered along the hood catch 2. The hook 121 ultimately engages with the lower end of the hood catch 2. At this time, the first abutment 112 of the main retention plate member 11 abuts on the bearing plate 13, as shown by a solid line in FIG. 7. Thus the key-shaped section 12 of the locking unit 1 is engaged with the hood catch 2. The locking unit 1 is in the locked state, as shown by solid lines in FIG. 4 and 7, with the hood 3 being in the closed state.

The elastic sealing member 33 is attached to the lower rim of the hood 3. Thus the hood 3 is closed in the intimately contacted state to prevent vibrations or noises derived from the engine or the like in the hood 3 from being propagated to outside. On the other hand, rainwater or dust and dirt are not intruded into the hood.

Thus the present invention provides a locking device for a hood which is simplified in construction and operation and excellent in appearance.

The above described locking device is provided within recess 39 of the hood 3 so that the driver's foot is not caught by the locking device. Thus the locking device for the hood according to the present embodiment is excellent in safety.

What is claimed is:

1. A locking device for securing a hood in closed position on an industrial vehicle where the hood has generally vertical side walls with bottom edges that engage substantially horizontal surfaces on the body of the vehicle when the hood is in closed position, said hood being joined to the body of said vehicle for pivoting movement about an axis adjacent a first side of said hood such that said edges separate from said horizontal surfaces upon opening of said hood, one of said vertical side walls on a side of said hood other than said first side having a recess within which is disposed a latching mechanism, a keeper secured to said surface of said vehicle body below said recess, said latching mechanism cooperating with said keeper and comprising a bearing plate having arms generally parallel and extending perpendicularly from said one side wall of the hood and a bight portion between said arms and secured to said one side wall within said recess, a latch plate which is generally sector-shape with a narrow side connected by diverging lateral sides to a broad side, and having a pair of notches formed in said broad side such as to provide in succession a hook portion adjacent a lateral side of the sector-shape plate, a first notch for receiving a portion of said keeper, a first stop finger, a notch for receiving one end of a biasing spring, and a second stop finger adjacent an opposite lateral side of the sector-shape plate, a heel portion on said latch plate on the narrow side, means pivotally mounting said latch plate between said arms of said bearing plate for rotation about an axis normal to said latch plate and passing through said latch plate between said heel portion and said broad side, a spring coupled between said bearing plate and said second notch in said latch plate for biasing said latch plate into latching engagement with said keeper when said hood is in closed position, an operating lever joined to said heel portion of said latch plate normal thereto and positioned, when said latch plate is in latch closed condition, substantially coplanar with the adjacent vertical side wall of said hood and dimensioned to fit within the entrance to said recess with a bottom edge substantially parallel to and spaced from the underlying surface of said vehicle body sufficient to permit convenient insertion of the fingers of a hand therebetween, said hook portion of said latch plate having an inclined outer edge which upon closing of an opened hood engages said keeper and acts through camming action to rotate said latch plate against the urging of said biasing spring until said hook portion snaps over and under said keeper into latching position.

2. A locking device according to claim 1, wherein said first and second stop fingers engage the bight portion of said bearing plate when said latching mechanism is in latching and unlatching position, respectively, to thereby limit rotation of said latch plate relative to said bearing plate.

3. A locking device according to claim 2, wherein said bottom edge of said operating lever is provided with an elastomeric jacketting.

4. A locking device according to claim 1, wherein said bottom edge of said operating lever is provided with an elastomeric jacketting.

* * * * *